US006098327A

United States Patent [19]

Gallant

[11] Patent Number: 6,098,327

[45] Date of Patent: Aug. 8, 2000

[54] CONNECTING DEVICE

[75] Inventor: Glenn Gallant, Winchester, Mass.

[73] Assignee: Disc Concepts, Inc., Mass.

[21] Appl. No.: 09/092,221

[22] Filed: Jun. 5, 1998

[51] Int. Cl.[7] ..... A44B 15/00

[52] U.S. Cl. ..... 40/634; 40/661.01; 40/600; 70/457; 70/460; D3/207

[58] Field of Search ..... 40/634, 330, 661.01, 40/600, 706, 781; 70/456 R, 457, 460; D3/207, 212

[56] References Cited

U.S. PATENT DOCUMENTS

| | | | |
|---|---|---|---|
| D. 364,734 | 12/1995 | Ben-Zeev et al. | D3/212 X |
| 1,110,760 | 9/1914 | Easton | 40/330 X |
| 1,800,064 | 4/1931 | Getts | 70/456 R |
| 3,956,913 | 5/1976 | Howard | 70/456 R |
| 4,214,463 | 7/1980 | Blumhof | 70/456 R |
| 4,932,230 | 6/1990 | Ishii et al. | 70/456 R |
| 5,024,078 | 6/1991 | Fenwick | 70/456 R |
| 5,388,439 | 2/1995 | Miller | 70/456 R |

*Primary Examiner*—Terry Lee Melius
*Assistant Examiner*—Rodrigo J. Morales
*Attorney, Agent, or Firm*—Paul J. Cook

[57] ABSTRACT

A connecting device is provided which is formed of a connecting section for supporting a discrete article such as a key, a display section which displays an image and a flexible section joined to the connecting section and display section.

9 Claims, 4 Drawing Sheets

CONNECTING DEVICE

BACKGROUND OF THE INVENTION

1. Field of Invention

This invention relates to a connecting device which can be connected to a support or to a discrete article such as a key. More particularly, this invention relates to a connecting device which includes a rigid display section, a connecting section and a flexible section attached to the display section and to the connecting section.

2. Description of Prior Art

Prior to the present invention, portable devices for storing keys, commonly referred to as a key chain, have been formed of a rigid or flexible material to which is directly attached a key ring. The key ring is formed of a single metal piece bent to form three concentric ring sections having two ends. A hole in the key is positioned over one end of the ring and is slipped about the ring until the concentric ring sections can be fit within the hole of the key. In an alternative structure, the key ring and rigid or flexible display section, in an exposed position, are joined together by a chain. The chain is attached to a rigid stationary ring positioned on the rigid or flexible material in an exposed position. The rigid or flexible display section usually includes an image or lettering to provide a message or design on the key chain. The major problem with these structures is that the point of stress during movement of the key chain is on the rigid stationary ring which is connected to the chain or to the key ring. Particularly, in the case of a rigid display section having the lettering or image, the stress on the exposed rigid stationary ring which houses the key ring can be fractured.

Accordingly, it would be desirable to provide a connecting device which includes a display section and a connecting section which are joined in a manner to substantially prevent transfer or stress between the connection point and the display section. It would also be desirable to provide such a connecting device wherein the connection point is unexposed and protected by a housing formed within the display section. Such a connection device structure would substantially extend the useful life of the connecting device.

SUMMARY OF THE INVENTION

The present invention provides a connecting device which includes a connecting section, a display section and a flexible section which joins the connecting section and the display section. The connecting section comprises an attachment means which permits the connecting device of this invention to be attached to a discrete article such as a key or to another attachment means such as a ring. The display section is formed from two mating subsections having prongs and holes wherein the prongs and holes permit attachment of the mating subsections. In one embodiment, the mating subsections can be joined together by ultrasonic welding.

The display section and connecting section are joined by a flexible section having at least one end joined to the display section. The end or ends of the flexible section joined to the display section are positioned within the housing section so that the connection point or points between the flexible section and the display section are protected by the housing against outside stress forces. In addition, since the flexible section is formed of a flexible material rather than a rigid material, it does not transfer stress force to the connection point or points.

DESCRIPTION OF SPECIFIC EMBODIMENTS

In accordance with this invention, a connection device is provided which includes a connecting section, a display section and a flexible section joining the connecting section and the display section. The connecting section can compose any element which permits it to be attached to an element having a hole or a ring or the like.

The display section is formed from two mating subsections which can be joined together by means of prongs and mating holes for the prongs. Optionally, at least one of the subsections can be provided with an ultrasonic focusing means which permits ultrasonic welding of the two subsections together. The display section has at least one subsection with an exposed surface imprinted with an image and/or lettering. The second subsection also can be imprinted with an image and/or lettering or can include a magnetic element which permit the connecting device to be magnetically attached to a ferromagnetic substrate such as a refrigerator door or a file cabinet outside surface. The magnetic element can be positioned within the display section or on an outside surface of the display section If desired, a magnet can be secured to the connecting section or on the flexible section.

One display subsection is provided with prongs which mate with openings in the second subsection to permit joining of the two subsections. At least one of the prongs and mating holes provides a means for attaching the flexible joining subsection thereto. The flexible joining subsection is provided with an opening which fits about one of the openings of one of the subsections while the prong of the mating subsection which fits into the opening of the other subsection also fits into the opening of the flexible subsection.

When the two subsections are joined together with the flexible subsection fitting about one of the prongs, the flexible subsection is retained between the two subsections, while being unexposed within the outside surfaces of the display section. This unexposed junction between the flexible section and the display section provides significant protection of the junction against stress originating from outside of the display section. This lack of exposure and the flexibility of the flexible section substantially reduces the risk of fracture of the juncture between the flexible section and the display section.

Figure 1:
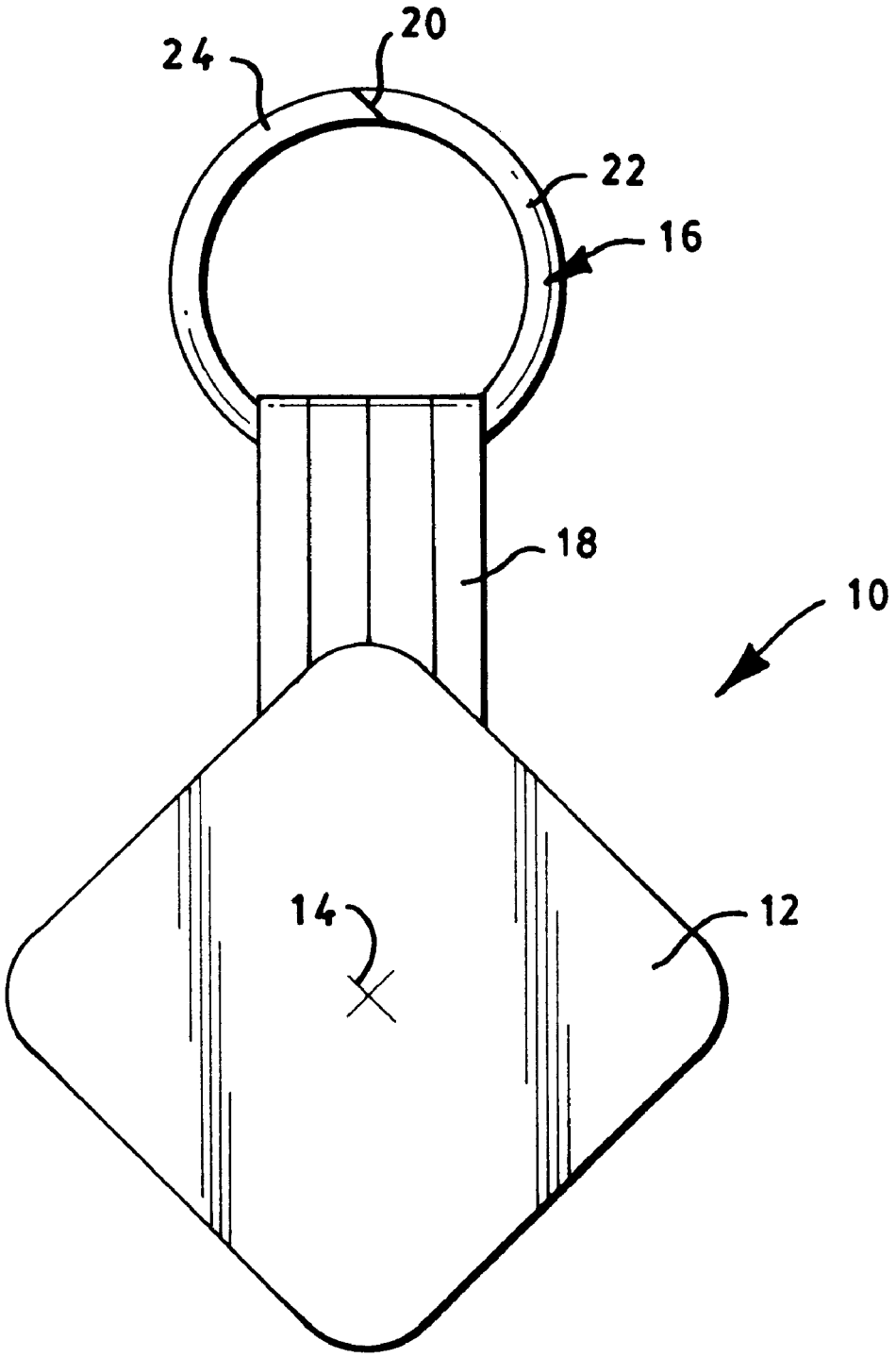
FIG. 1 is a top view of a connecting device of this invention.

Referring to FIG. 1, the connection device of the invention 10, includes a display section 12 having an image and/or lettering 14, a connection section 16 and a flexible connection section 18 which is attached to display section 12 and connecting section 16. The flexible connection section 18 can be easily bent or twisted by hand. The flexible section 18 is conveniently formed from woven fibers or yarn such as are formed of a polymeric fiber or yarn. The connecting section 16 is illustrated as a connecting ring having an exposed end 20 which permits separation of connecting ring section 22 and intermediate ring section 24 so that an element to be attached such as a key having hole can be slideably positioned between ring section 72 and 24 so that the entire connecting section 16 can be positioned within the key hole (not shown) to retain the key (not shown). The connecting ring section 22 is formed of at least two concentric rings and, preferably at least three concentric rings.

The flexible section 18 permits rotation of the ring 16 and elements connected to the ring 16 in a manner which substantially eliminates stress forces on a connecting point between the flexible element 18 and the display section 12. This, in turn, substantially reduces the probability of the flexible element 18 and the display section 12 from separating from each other.

Figure 2:
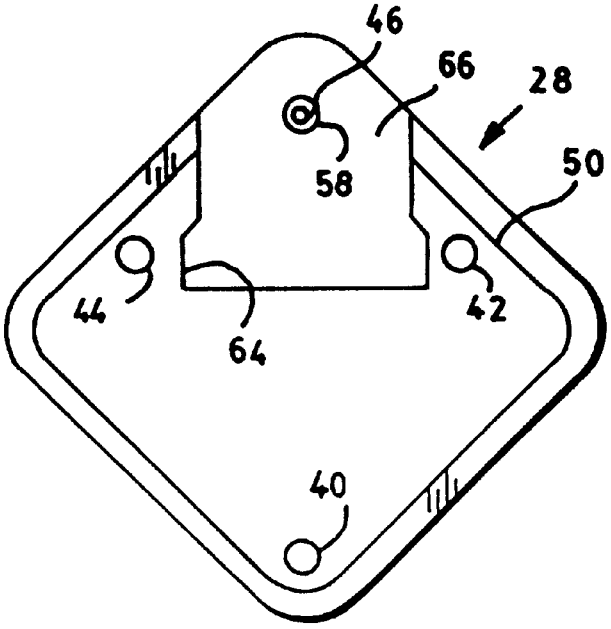
FIG. 2 is a side view of a subsection of a display section of the connecting device of FIG. 1.
Figure 3:
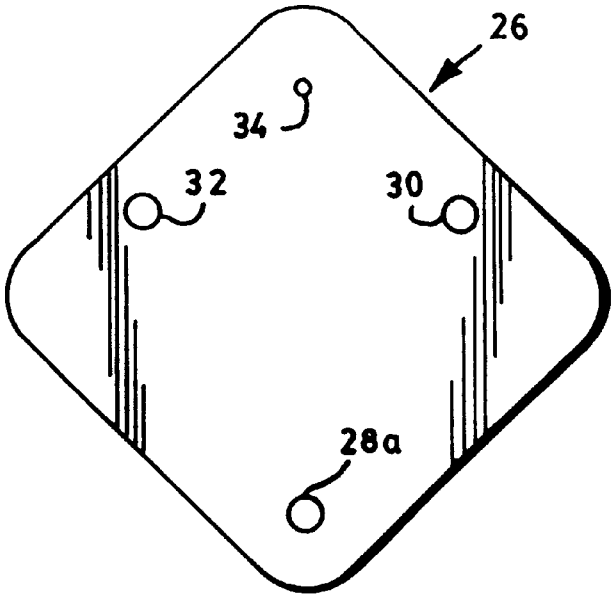
FIG. 3 is a side view of a subsection of FIG. 2 to form the display section.

Referring to FIGS. 2 and 3, representative display section subsections 26 and 28 are shown. Subsection 26 is provided with prongs 28 and 30 and 32 and prong 34 conveniently formed of a polymeric composition that can be melted with ultrasonic energy. The remaining surface 38 is substantially flat. The mating subsection 28 is provided with opening 40, 42 and 44 which mate respectively with prongs 28, 30 and 32. In addition, prong 34 mates with opening 46. Optionally, a groove 50 can be provided which provides an ultrasonic energy concentrating line to join subsections 26 and 28 with ultrasonic energy. Groove 50 serves to focus ultrasonic energy to melt its polymeric composition so that the two subsections 26 and 28 can be fused together. Additionally, the prongs 28, 30, 32 and 34 provide an ultrasonic energy surface which promotes joining of subsection 26 and 28. When subsections 26 and 28 are thus joined, groove 66 forms a space with surface 38 so that flexible section 18*a* or 18 (FIGS. 5*a* and 5) can be positioned therein.

Figure 5A:
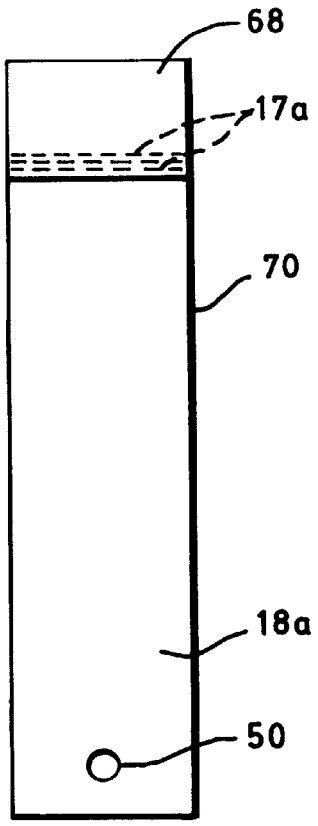
FIG. 5*a* is a top view of an alternative flexible section useful in the present invention.
Figure 5:
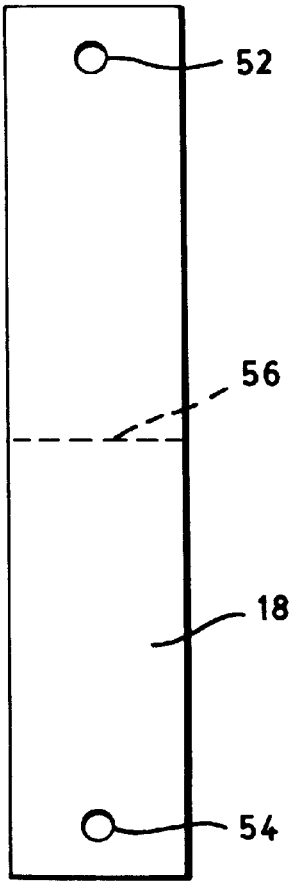
FIG. 5 is a top view of a flexible section useful in the connecting device of this invention.

As shown in FIGS. 5 and 5*a*, the flexible sections 18 or 18*a* such as formed from woven or non-woven yarn, cloth, leather or a flexible polymer composition or the like can be provided with one hole 50 or two holes 52 and 54. The flexible section 18 can be folded on line 56 so that holes 52 and 54 mate and so that they can be positioned over prong 34 which mates with opening 46. The subsections 26 and 28 are positioned together after openings 52 and 54 of flexible section 18 are positioned about prong 34. The subsections 26 and 28 can be joined together by any conventional means, such as with an adhesive or an ultrasonic weld which effects joining of the prongs 28*a*, 30, 32 and 34 within the mating openings 40, 42, 44 and 46 as well as groove 50 to surface 38 of subsection 26. In this manner, the subsections 26 and 28 form an essentially permanent juncture which includes flexible element 18. The optional flaring area 64 in groove 66 provides a housing for the flexible section 18 including any frayed wear at the ends thereof in flaring area 64.

An alternative flexible section is shown in FIG. 5*a* wherein the flexible section 18*a* comprises a folded over length 68 joined together with its remaining section 70 by sewing line 72 to form a secured opening into which ring 16 (FIG. 4*a*) can be positioned. This embodiment of this invention reduces by one-half the thickness of the flexible section 18*a* thereby reducing the thickness of display section 12.

Figure 4A:
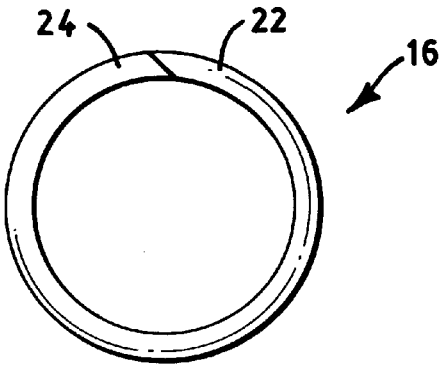
FIG. 4*a* is a side view of the connecting section of FIG. 4.
Figure 4:
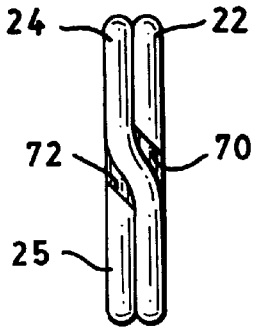
FIG. 4 is a top view of a connecting section useful in the connecting device of this invention.

Connecting section 16 as shown in FIGS. 4 and 4*a* comprises a ring having concentric sections 22, 24 and 25 in a manner well known in the art. For example, a conventional key hole can be fit between end 70 and ring 24 to slide the key about sections 22, 24 and 25 to position the key hole from the space 72 and so that the key is positioned onto the connecting section 16 Alternatively, the connecting section can be attached to any other subsection which accepts it, such as a ring or the like.

Figure 6:
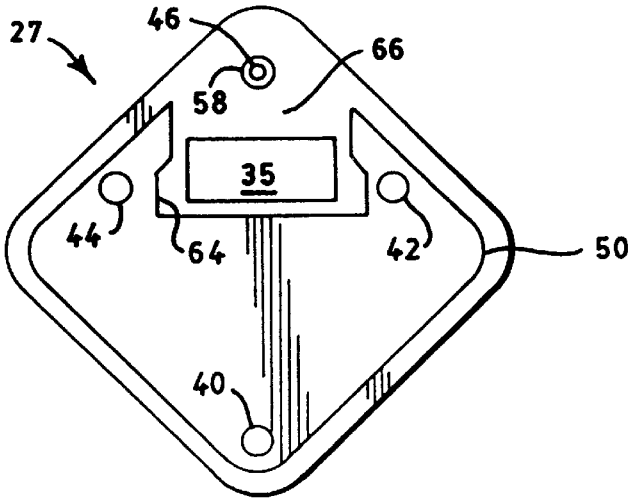
FIG. 6 is a side view of a display section having magnets on its outside surface.

Referring to FIG. 6, display subsection 27 shown. The same elements of FIGS. 2 and 6 are identified by the same reference numerals. The subsection 2 is provided with opening 40, 42 and 44 which mate respectively with prongs 28, 30 and 32 (FIG. 3). In addition, prong 34 mates with opening 46. Optionally, a groove 50 can be provided which provides an ultrasonic energy concentrating line to join mating subsections with ultrasonic energy. Groove 50 serves to focus ultrasonic energy to melt its polymeric composition so that the two subsections 26 and 28 can be fused together. Additionally, the prongs 28, 30, 32 and 34 provide an ultrasonic energy surface which promotes joining of mating subsections. A magnet 35 is positioned within groove 66 such as by being adhered to display subsection 27.

Figure 7:
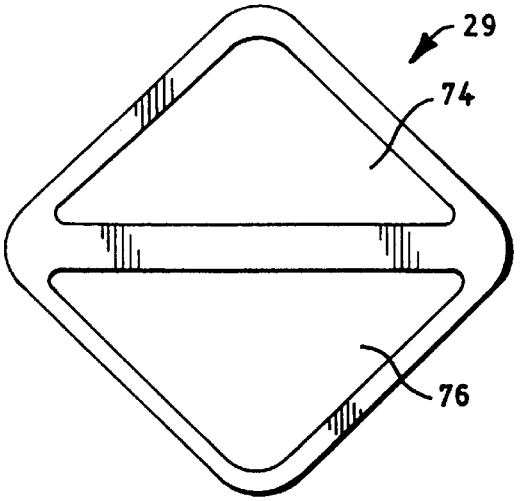
FIG. 7 is a side view of a display section having magnets on its inside surface.
Figure 8:
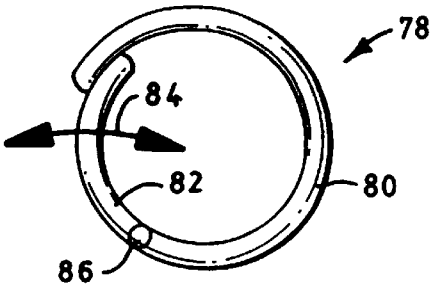
FIG. 8 is a side view of an alternative connecting section useful in the present invention.

Referring to FIG. 7, display subsection 29 includes magnets 74 and 76 secured to its outside surface sich as with an adhesive.

I claim:

1. A connecting device which comprises:

a connecting section comprising at least two concentric rings for supporting a discrete article, through a hole in said discrete article, a display section formed of two mating subsections, said subsections being fixedly joined to each other by at least one prong on one of said mating subsections which fits into at least one hole on a second of said mating subsections and, when joined together form a space between said mating subsections, and a flexible strap section joined to said connecting section and joined to said display section within said space.

2. The connecting device of claim 1 wherein said two mating subsections are joined by at least two prongs on one of said mating subsections which fits into at least two holes on a second of said mating subsections.

3. The connecting device of any one of claims 1, or 2 wherein said flexible section is formed of woven yarn.

4. The connecting device of claim 1 wherein said at least one prong is ultrasonically welded within said at least one hole.

5. The connecting device of claim 2 wherein said at least two prongs are ultrasonically welded within said at least two holes.

6. The connecting device of any one of claims 1, or 2 which includes a magnet secured thereto.

7. The connecting device of claim 3 which includes a magnet secured thereto.

8. The connecting device of claim 6 wherein said magnet is secured to said display section.

9. The connecting device of claim 7 wherein said magnet is secured to said display section.

* * * * *